US008398080B2

(12) United States Patent
Stolten

(10) Patent No.: US 8,398,080 B2
(45) Date of Patent: Mar. 19, 2013

(54) APPARATUS USEFUL AS A TOY, PUZZLE OR AS AN EDUCATIONAL DEVICE

(75) Inventor: Mark Randall Stolten, Auckland (NZ)

(73) Assignees: Mark Randall Stolten, Auckland (NZ); Elizabeth Mary Stolten, Auckland (NZ); Frederick Brian Worrall, Tauranga (NZ)

( * ) Notice: Subject to any disclaimer, the term of this patent is extended or adjusted under 35 U.S.C. 154(b) by 628 days.

(21) Appl. No.: 12/223,469

(22) PCT Filed: Jan. 31, 2007

(86) PCT No.: PCT/NZ2007/000023

§ 371 (c)(1),
(2), (4) Date: Jul. 31, 2008

(87) PCT Pub. No.: WO2007/089160

PCT Pub. Date: Aug. 9, 2007

(65) Prior Publication Data

US 2009/0036019 A1 Feb. 5, 2009

(30) Foreign Application Priority Data

Jan. 31, 2006 (NZ) ..... 545069

(51) Int. Cl.
*A63F 9/00* (2006.01)

(52) U.S. Cl. ..... 273/153 R; 273/153 S; 446/138; 434/188

(58) Field of Classification Search ..... 434/188; 273/153 R, 156, 157 R, 153 S; 446/138
See application file for complete search history.

(56) References Cited

U.S. PATENT DOCUMENTS

| | | | | | |
|---|---|---|---|---|---|
| 463,230 | A | * | 11/1891 | Hooly | 434/206 |
| 2,496,498 | A | * | 2/1950 | Shields | 434/174 |
| 4,415,158 | A | * | 11/1983 | Engel | 273/153 S |
| 4,865,324 | A | * | 9/1989 | Nesis | 273/155 |
| 4,902,230 | A | | 2/1990 | Jones | |
| 4,949,969 | A | * | 8/1990 | Johnson | 273/153 S |
| 5,083,788 | A | * | 1/1992 | Conotter | 273/153 S |
| 5,957,453 | A | * | 9/1999 | Binkley | 273/153 S |
| 6,142,784 | A | * | 11/2000 | Wood | 434/201 |
| 6,881,066 | B1 | * | 4/2005 | Sarconi | 434/174 |
| 2005/0029735 | A1 | * | 2/2005 | Liu et al. | 273/156 |

FOREIGN PATENT DOCUMENTS

| | | |
|---|---|---|
| WO | WO 98/31441 | 7/1998 |
| WO | WO 2004/039465 | 5/2004 |

* cited by examiner

*Primary Examiner* — Gene Kim
*Assistant Examiner* — Joseph B Baldori
(74) *Attorney, Agent, or Firm* — Jacobson Holman PLLC

(57) ABSTRACT

An apparatus useful as an educational device, puzzle or toy of a kind having magnetic interactions between an elongate support and pieces held, or to be held, with or without contact, about said support, wherein a plurality of said pieces collectively form, or can form, a first band of pieces about said support, and another plurality of said pieces form, or can form, a second band of pieces about the support, and wherein at least one piece of each said band has an indicia, said indicia of a piece in one band being able to be indexed to an indicia of a piece of the other band, and wherein at least one of the bands of pieces is able, or will be able, to be rotated about the elongate axis of the support.

14 Claims, 4 Drawing Sheets

APPARATUS USEFUL AS A TOY, PUZZLE OR AS AN EDUCATIONAL DEVICE

This is a national stage of PCT/NZ2007/000023 filed Jan. 31, 2007 and published in English.

FIELD OF THE INVENTION

The present invention relates to an apparatus useful as a toy or as an educational device, and more particularly to but not exclusively it relates to an educational magnetic toy or device.

BACKGROUND

Various types of magnetic toys, that may or may not have an educational component, have been provided for children. Examples include flat surfaces whereby indicia inscribed pieces can be magnetically attached to a flat surface, the method of use being related to being educational or as a toy. A further example includes a magnetic education toy such as disclosed in U.S. Pat. No. 4,295,832. U.S. Pat. No. 4,295,832 discloses the placement of single magnetic members that are slideably received onto an elongated support rod. In this example the magnetic interaction is between groups of members. Each member of a group may incorporate an indicia.

It is an object of the present invention to provide a device useful as a toy or as an education device which at least provides the public with a useful choice.

Other objects of the invention may become apparent from the following description which is given by way of example only.

BRIEF DESCRIPTION OF THE INVENTION

In a first aspect of the invention there is provided an apparatus useful as a toy or as an educational device, the apparatus comprising in combination, as a kit or otherwise:

a support having an axis, pieces of a first kind supportable as a set in a band about the axis of the support and rotatable relative thereto, and pieces of a second kind supportable as a set in a band about the axis of the support (optionally able to be rotatable relative to said support).

Preferably there is no attachment piece to piece in a band but there is to be, or there is, a magnetic interaction between the support and each piece.

Preferably there axe at least pieces for at least three bands each as a set such that alignment of one piece of one band with at least one piece or part of one piece of one or more of the other bands can define at meaningful equation, statement, expression or the like useful in a game or as an educational aide.

Preferably at least one piece of each said band has an indicia. More preferably, each said piece has an indicia.

Preferably said alignment is of at least one said indicia of a band with an indicia of another said band.

In one aspect the invention is an apparatus requiting an alignment for the purpose of play, education or puzzle solving characterised in that axially spaced along a rotation axis there is (a) preferably at least one circumferential band of discrete indicia able as a whole to be rotated, and (b) a further circumferential band of indicia (discrete or otherwise) (able to be rotated or not).

Preferably said rotation axis is about a elongate support to which at least one (and preferably several) said circumferential band(s) is able to rotate (with or without contact).

Preferably at least one of each said indicia forms part of a piece.

Preferably a number of pieces collectively form a said circumferential band.

Preferably there is no attachment piece to piece in a band but there is to be, or there is, a magnetic interaction between the support and each piece.

Preferably at least two bands can be rotated. Preferably at least three bands can be rotated.

In a further aspect of the invention there is provided an apparatus useful as an educational device or toy of a kind having magnetic interactions between an elongate support and pieces held, or to be held, with or without contact, about said support, wherein a plurality of said pieces collectively form, or can form, a first band of pieces about said support, and another plurality of said pieces form, or can form, a second band of pieces about the support, and wherein at least one piece of each said band has an indicia, said indicia of a piece in one band being able to be indexed to an indicia of a piece of the other band, and wherein at least one of the bands of pieces is able, or will be able, to be rotated about the elongate axis of the support.

Preferably said apparatus comprises at least one end cap located at one end of said elongate support. More preferably each end of said elongated support comprises an end cap having each of said bands located there in-between.

In one embodiment said apparatus comprises at least three or more bands of pieces, at least two or all of said bands being able to be rotated about said support relative to one another.

In a further embodiment of the present invention, one band may be fixed in place, either statically in respect of said support, or by being attached (integrally or not) to said support. Said fixed band may be separated into pieces, and each pieces fixed to said support, or the entire band itself formed as a single piece and fixed (or integrally moulded etc) to said support.

In one embodiment of the present invention, said apparatus comprises at least three bands, at least one piece of each band having indicia such that the apparatus comprises:

1. a first band having at least one piece with an indicia (in the form of a numeral(s)),
2. a second band having at least one piece marked with an operator (i.e. subtraction sign, multiplication sign, division sign, or addition sign) and a numeral(s) and
3. a third band having at least one piece marked with a numeral(s) corresponding to the correct answer from the association of the numeral of said first band with the numeral of the second band, subject to the operator.

In one embodiment said subtraction operator and said numeral are on separate bands, such that a device of this embodiment would have at least four bands of pieces when in assembly.

Preferably the third band is marked (e.g. by colour) to indicate a correct answer or correct alignment of pieces. More preferably the third band is marked by colour such that it corresponds to a similar colour on another band. Preferably said colour on said third band matches to the colour of the number and/or operator of a second band.

In one embodiment, said third band comprises several answers, each marked such that only one answer will correspond correctly to the association of said first and second bands.

In a further embodiment said apparatus comprises an indicator that allows a user of said apparatus to determine when a correct combination of said indicia is aligned. Preferably said indicator is electronic and comprises such thing as a visual indication (e.g. flashing light), auditory indication (e.g. siren, music etc) etc.

In a further embodiment said apparatus includes a timing device, said timing device allowing a user to time a task (i.e. the time to align a predetermined number of indicia). Preferably said timing device is electronic.

In a further embodiment said apparatus comprises a device that gives instructions to a user.

In a further embodiment of the present invention, said apparatus may comprise indicia to facilitate the teaching of a subject matter such as geography, grammar, spelling etc.

Preferably a plurality of associated pieces collectively form a band.

In one embodiment each band is divided into eight pieces and each said piece has an arc length of substantially the same size. More preferable, the exterior area of each piece is of substantially the same geometric shape. Preferably said area is a rectangle.

Preferably said magnetic interaction is provided for by a magnet on each said piece, and wherein said support is made of a ferrous metal.

In one embodiment of the invention at least one said band, when rotated about said support, provides feedback to the user of said apparatus. Said feedback allows the user to determine when a piece is correctly indexed relative to an adjacent piece of an adjacent band.

Preferably said feedback during movement provides at least one or more of the following outcomes:

a sense of moving beyond an indexed position, and a sense of indexing to a desired or correct position.

In one embodiment said feedback mechanism has a noise, a "feel" due to a physical mechanism, or a change in a physical feature of said apparatus that can indicate to the user when any piece is rotated or correctly indexed to a particular position relative to an adjacent band.

In one embodiment said feedback mechanism is provided by a ratcheting mechanism which provides a sound and/or a feel when a piece is rotated about said support. Preferably said feedback is due to the interaction between said ratcheting mechanism and a physical projection that interacts with said ratcheting mechanism.

Preferably the feedback mechanism is located on a surface of a piece, other than that with the indicia and other than a surface proximate to a surface already carrying said feedback mechanism. Preferably said feature or features interacts with either a feature on the support (whether a fixed band or otherwise) or with pieces of another rotatable band.

In one embodiment each piece comprises on opposing surfaces either:

1. ratcheting mechanisms on each of said opposed surfaces,
2. a ratcheting mechanism on one surface, and a physical projection on the opposing surface, or
3. physical projections on each of said opposing surfaces.

Preferably said physical projection is in the form of an cantilevered arm articulated or non-articulated formed from a cut away from said piece.

Preferably said cantilevered arm is biased to a position such that it exerts pressure of said ratcheting mechanism.

According to a further aspect of the invention is the use of a device or toy of the invention as described.

According to a further aspect of the invention there is a method to assist teaching a subject matter to a user consisting or comprising of the steps of:

1. providing an apparatus of the present invention, said apparatus having indicia directed towards a subject matter to be taught,
2. assembling said apparatus if requited,
3. rotating said bands relative to each other such that said user associates together matching indicia on at least two of said bands, and wherein an alignment of at least one indicia of a piece of one band with at least another indicia of one piece or part of one piece of one or more of the other bands can define at meaningful equation, statement, expression or the like which assists the teaching of said subject matter.

In one embodiment of the present invention, at least one band is further marked such that a user can determine whether or not that have correctly matched the indicia of said two or more bands. In an alternate embodiment, said apparatus comprises an indicator (for example a flashing light, auditory sound etc), that provides feedback to a user based on whether a correct answer (in the form of correct alignment of pieces) is achieved. Preferably said feedback is electronic.

In one embodiment of the present invention, said method is a method of teaching subtraction, multiplication, division or addition. A device of this method comprises at least three bands, at least one piece of each band having indicia such that the apparatus comprises:

1. a first band marked with a first numeral or numerals,
2. a second band marked with an operator (i.e. subtraction sign, multiplication sign, division sign, or addition sign) and a second numeral or numerals, and
3. a third band marked at least with a numeral or numerals corresponding to the correct answer from the association of a first number with the number of the second band, subject to the operator.

In one embodiment said subtraction operator and said second numeral or numerals are on separate bands, such that a device of this embodiment would have at least four bands of pieces in assembly.

According to a further aspect of the invention there is provided an educational toy or device substantially as herein described and with reference to any one or more of the accompanying drawings and/or examples. Other aspects of the invention may become apparent from the following description which is given by way of example only and with reference to the accompanying drawings As used herein "band" means a set of indicia providing some semblance of continuity about the axis and does not connote any need for a connection of the discrete indicia.

As used herein the term "indicia" means any marking, sign, colour, numeral, letter, symbol, word, picture or the like.

As used herein the term "discrete indicia" refers to an indicia that does not reply on any other indicia to convey a meaning.

As used herein "circumferential" does not necessarily require any cylindrically of the band or any support thereof.

As used herein the term "and/or" means "and" or "or" or both.

To those skilled in the art to which the invention relates, many changes in construction and widely differing embodiments and applications of the invention will suggest themselves without departing from the scope of the invention as defined in the appended claims The disclosures and the descriptions herein are purely illustrative and are not intended to be in any sense limiting.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

BRIEF DESCRIPTION OF THE DRAWINGS

The invention will now be described by way of example only and with, reference to the drawings in which.

Figure 1:
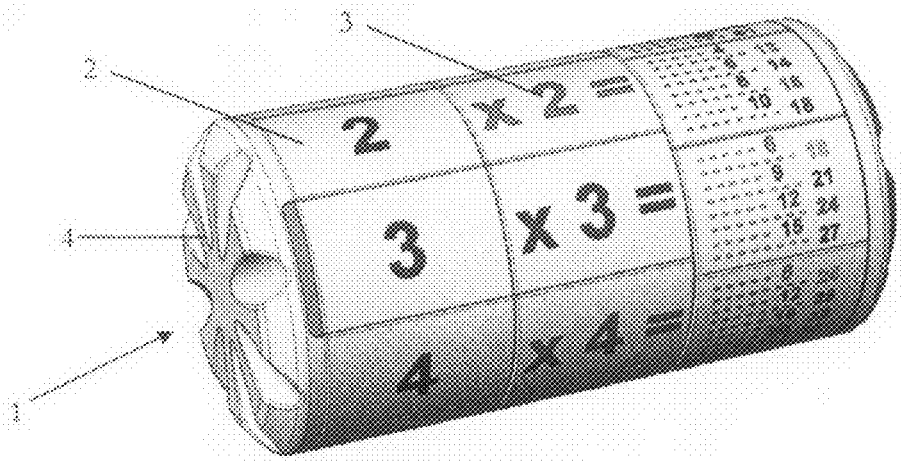
FIG. 1 is a perspective view of an apparatus of a preferred embodiment of the invention.

In one aspect of the invention there is provided an apparatus 1 useful as a toy or as an educational device, the apparatus 1 comprising in combination, as a kit or otherwise of:

a support 5 having an axis, pieces 2 of a first kind supportable as a set in a band about the axis of the support 5 and rotatable relative thereto, and pieces 2 of a second kind supportable as a set in a band about the axis of the support 5 (optionally able to be rotatable relative to said support 5).

Preferably there is no attachment piece 2 to piece 2 in a band but there is to be, or there is, a magnetic interaction between the support 5 and each piece 2.

Preferably there are at least pieces 2 for at least three bands each as a set such that alignment of one piece 2 of one band with at least one piece 2 or part of one piece 2 of one or more of the other bands can define at meaningful equation, statement, expression or the like useful in a game or as an educational aide.

Preferably at least one piece 2 of each said band has an indicia 3. More preferably, each said piece 2 of a band has an indicia 3.

Preferably said alignment is of at least one said indicia 3 of a band with an indicia 3 of another said band.

In another embodiment of the present invention there is provided an apparatus 1 requiring an alignment for the purpose of play, education or puzzle solving characterised in that axially spaced along a rotation axis there is (a) preferably at least one circumferential band of discrete indicia 3 able as a whole to be rotated, and (b) a further circumferential band of indicia 3 (discrete or otherwise) (able to be rotated or not).

Preferably said rotation axis is about a elongate support 5 to which said circumferential band(s) is able to rotate (with or without contact).

Preferably at least one of each said indicia forms part of a piece 2.

Preferably a number of pieces 2 collectively form a said circumferential band.

Preferably there is no attachment piece 2 to piece 2 in a band but there is to be, or there is, a magnetic interaction between the support 5 and each piece 2.

In another embodiment of the present invention there is provided an apparatus 1 as an educational device or toy of a kind having magnetic interactions between an elongate support 5 and pieces 2 held, or to be held, with or without contact, about said support 5, wherein a plurality of said pieces 2 collectively form, or can form, a first band of pieces 2 about said support 5, and another plurality of said pieces 2 form, or can form, a second band of pieces 2 about the support 5, and wherein at least one piece 2 of each said band has an indicia 3, said indicia 3 of a piece 2 in one band being able to be indexed to an indicia 3 of a piece 2 of the other band, and wherein at least one of the bands of pieces 2 is able, or will be able, to be rotated about the elongate axis of the support 5.

Preferably said apparatus comprises at least one end cap 4 located at one end of said elongate support 5. More preferably each end of said elongated support 5 comprises an end cap 4 having each of said bands located there in-between.

In one embodiment said apparatus comprises at least three or more bands of pieces 2, at least two or all of said bands being able to be rotated about said support relative to one another.

In a further embodiment of the present invention, one band may be fixed in place, either statically in respect of said support, or by being attached (integrally or not) to said support 5. Said fixed band may be separated into pieces 2, and each pieces fixed to said support 5, or the entire band itself formed as a single piece and fixed (or integrally moulded etc) to said support 5.

It should be appreciated that the pieces of the apparatus may or may not contact with the support. For example, in one instance the combination of pieces in assembly forming a band around said support may have an internal diameter greater than that of the support and that the pieces are held above the support due to their magnetic interaction but owing to contact piece to piece are unable to reduce in diameter to have contact on to the support.

Alternatively each piece may contact the support directly as well as optionally contacting to an adjacent piece or not.

Furthermore, the invention describes a method to assist teaching a subject matter to a user consisting or comprising of the steps of:

1. providing an apparatus of the present invention, said apparatus having indicia 3 directed towards a subject matter to be taught,
2. assembling said apparatus if required,
3. rotating said bands relative to each other such that said user associates together matching indicia 3 of a piece or pieces of at least two said bands, and Wherein an alignment of at least one indicia 3 of a piece 2 of one band with at least another indicia 3 of one piece 2 or part of one piece 2 of one or more of the other bands can define at meaningful equation, statement, expression or the like which assists the teaching of said subject matter.

In one embodiment of the present invention, at least one band is further marked such that a user can determine whether or not that have correctly matched the indicia 3 of said two or more bands.

It should also be appreciated that while the examples below are directed to a tangible apparatus, the apparatus could also be represented using electronic means wherein the apparatus, and the method of operation is represented on-screen.

Apparatus Pieces (2)

Figures 5, 6:
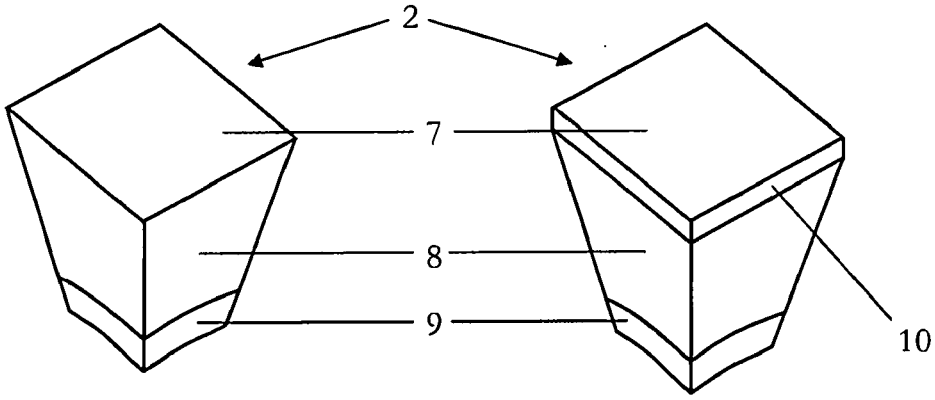
FIG. 5 is a perspective view of a piece.
FIG. 6 is a perspective view of a piece.
Figure 7:
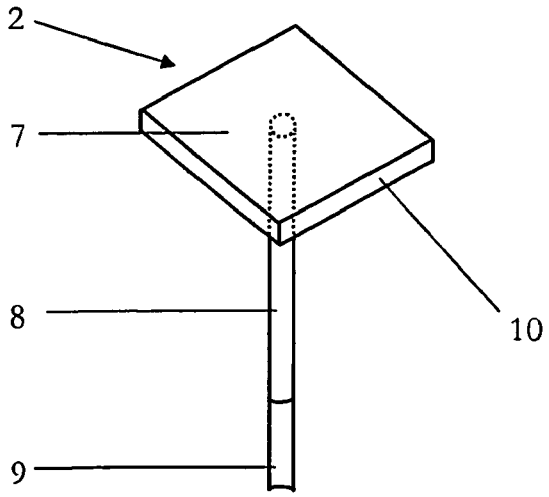
FIG. 7 is a perspective view of a piece.

With reference to FIGS. 5 to 7, different configurations of pieces 2 are shown. Each piece 2 has an outer area 7 which forms the exterior surface of a band. This area 7 can be connected magnetically to the support 5 via a connector comprising a spacer 8 and a connector element 9.

As depicted in FIGS. 5 to 7, the collective areas 7 or each of the pieces 2 forming a band has a surface with a diameter greater than that of the support 5. In order to achieve this, each piece 2 comprises a spacing element which projects the area 7 from the surface of support 5. FIGS. 5 and 6 depict a wedge-shaped spacer 8, while FIG. 7 depicts a rod like mechanism.

Figure 12:
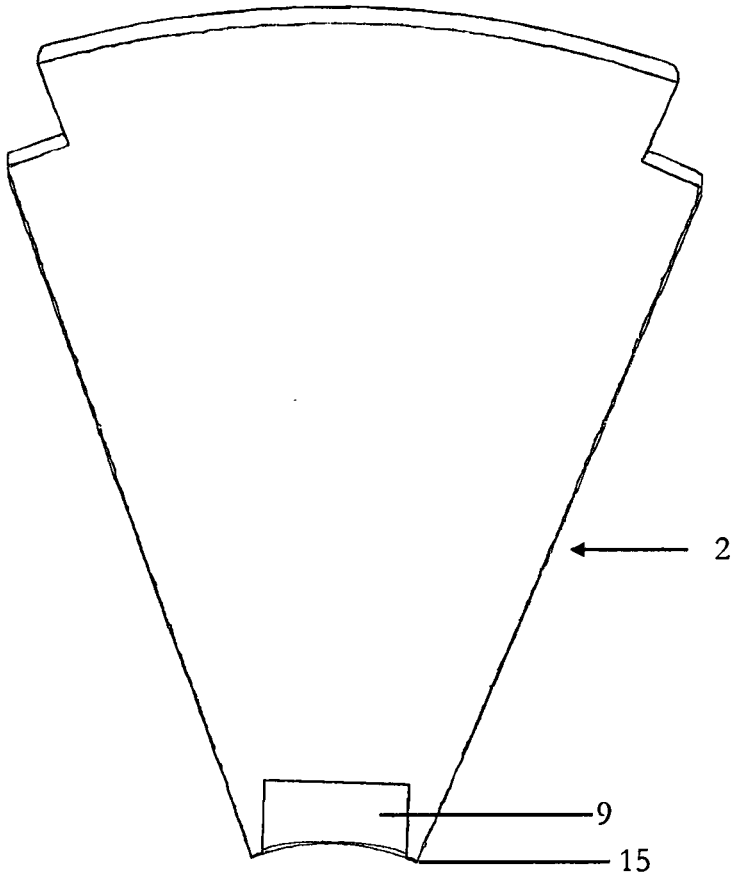
FIG. 12 is a cross-sectional view of a piece through AA.
Figure 13:
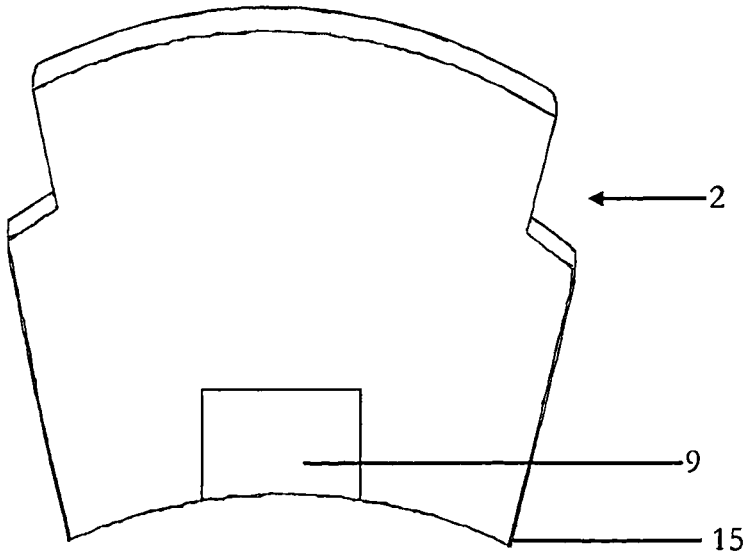
FIG. 13 is a cross-sectional view of a piece through AA.

It should be appreciated that the relative size of the support 5 to the total apparatus size can be varied. i.e. to put another way, it should be appreciated that, the height of the pieces 2 could range greatly relative to the diameter of the support 5. For example, it can be seen that the ratio of the height to width is greater for the piece 2 shown in FIG. 12 compared to FIG. 13.

It should also be appreciated that as the height of a piece 2 decreases relative to its width, the distance of the magnet to the edge of the piece 2 can be increased therefore decreasing the magnetic interaction with other adjacent playing pieces. This can be seen when comparing the piece 2 of FIG. 13 to that of the puzzle piece 2 shown in FIG. 12.

It should also be appreciated that the magnetic element can extend any part thereof through the playing piece.

Many different combinations of the elements that comprise each piece can be integrally moulded. For example, as shown in FIG. 6, an area 7 may be integrally moulded with a spacer 8. Alternatively, as shown in FIG. 5, a piece 2 may comprise a separate area 7 which is then associated with an integrally moulded connector comprising the spacer 8 and connector element 9.

Said pieces may or may not be contact with said support, but nevertheless be held in place around said support owing to magnetic interactions between said piece and said support.

In some embodiments said area 7 may have indicia, indentations, projections, contours or surface configurations that project from the general surface of a piece 2.

As shown in FIG. 7, a piece 2 may comprise an area 7 in the form of a tile. In one embodiment each tile is connected to the support 5 via a connector, said connector comprising a spacer 8 and a connector element 9. As stated above, many different combinations of each element could be integrally moulded.

In a preferred embodiment, each piece 2 is connected to the support 5 using magnetic attraction.

It should be appreciated that a number of different configurations providing for the magnetic interaction can be provided. For example, each of said connectors 9, or part thereof, may be formed from a magnetic element. e.g. rare earth magnet, with the support 5, or part thereof, being formed from a ferrous metal. In this embodiment the support 5 may be formed as a rod, cylinder or the like. Other configurations may also be used that allow rotation of said pieces 2 around the support 5.

In an alternate embodiment the support 5, or part thereof, may comprise the magnetic element and therefore the connector 9, or part thereof, comprise the ferrous element. Preferably the magnetic element used is a rare earth magnet. In such an instance the support 5 may be, for example, a rod-shaped magnet, a hollow cylinder-shaped magnet or the like. Other configurations may also be used that allow rotation of said playing pieces 2 around the support 5.

While FIGS. 6 and 7 depict the connector element 9 as a separate entity to that of the spacer 8 and the area 7 (whilst optionally integrally moulded), it is envisaged that the connector element may form an integral component of each piece 2. For example, a said piece 2 may comprise, wholly or in part, a moulded material having magnetic properties.

Preferably when said piece(s) 2 comprises a magnet, said magnet is located distal to said area 7. i.e. located adjacent to the surface of said support 5.

In one embodiment the entire connector may be a magnet. In an alternate embodiment the magnet may only form a small part of the connector such that the magnet is embedded in the connector with only its lower surface (i.e. that surface to be adjacent to said support 5) located at or near the lower surface of said puzzle piece 2. With reference to FIG. 12 the connector element 9 is shown as a magnet recessed into a piece 2. The lower periphery 15 of the piece 2 can be seen to project beyond that of the magnet. Therefore, as a piece 2 is moved around the support 5 it is the material of the lower periphery 15 of the piece 2 (i.e. plastics) that contacts the support 5, and not the actual magnet itself. As shown in FIG. 12 the magnet projects only a short way up into a piece 2. It should be appreciated that many dimensions of magnets could be used. For example, magnets with dimensions that extend a greater proportion of the way into a piece 2, and/or magnets of varying width in relation to the width of the piece 2.

Indexing of the Pieces

In one embodiment the rotation of said pieces 2 around said support 5 provides feedback to the user. Said feedback allows the user to determine when the pieces 2 are moved, and when they are lined up with an adjacent piece of an adjacent band. Preferably said feedback during movement provides at least one or more of the following outcomes:

1. a sense of moving beyond an indexed position, and
2. a sense of indexing to a correct playing position.

Said feedback mechanism can be a noise, a "feel" i.e. due to a physical mechanism, or a change in a physical feature of said apparatus 1 that can indicate to the user when a piece 2 is moved.

Figure 8:
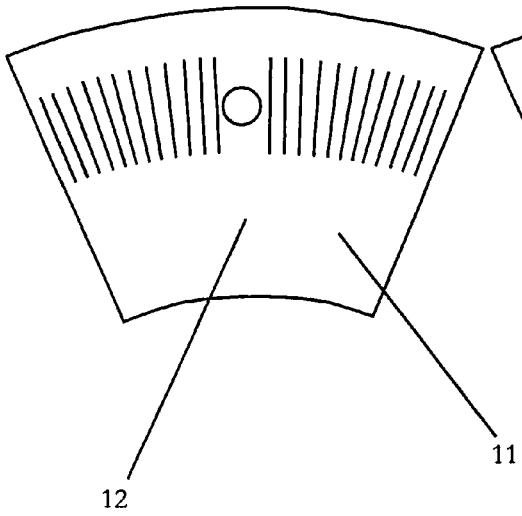
FIG. 8 is a side view of a piece showing the ratcheting mechanism and surface indentation.
Figure 9:
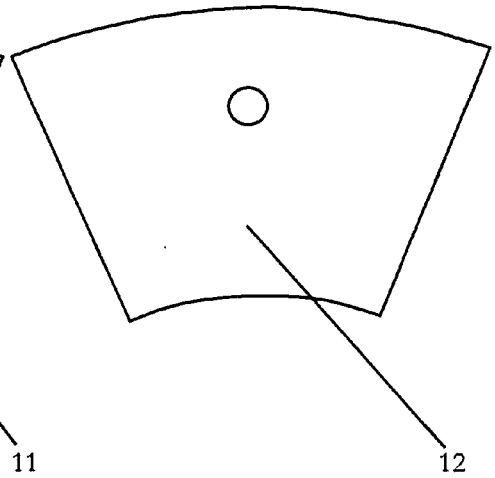
FIG. 9 is a side view of a piece showing the physical projection.
Figure 10:
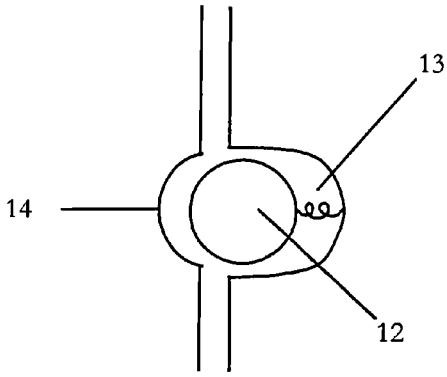
FIG. 10 is a side view of the interaction between two pieces showing the feedback mechanism.

With reference to FIGS. 8 to 10, in one embodiment said feedback mechanism is provided by a ratcheting mechanism 11 which provides a sound and/or a feel when said pieces 2 are moved due to the interaction with said ratcheting mechanism 11 with a physical projection that interacts with said ratcheting mechanism 11.

In one embodiment said ratcheting mechanism 11 is localised on the surface of a said piece (refer FIG. 9).

In one embodiment said physical projection is in the form of a projection that is on a piece that does not have localised thereto a ratcheting mechanism. Preferably said physical projection is able to interact with said ratcheting mechanism 11 to provide feedback to the user as to when a playing piece is moved.

It should be appreciated that any piece can have localised on one or more of its surfaces either:

1. a two ratcheting mechanism,
2. a ratcheting mechanism and a physical projection, or
3. at least two physical projections.

Preferably the components of the feedback system are localised on opposing surfaces of the piece such that they contact both an adjacent piece. Should a single piece have both opposing side surfaces ratcheting mechanism, then the adjacent pieces would require to have physical projections to interact with the ratcheting mechanism on that piece. Alternatively should a piece have on one surface a ratcheting mechanism, and on the opposing surface the physical projection, then the pieces either side of that piece would require that the surfaces in contact with the middle piece have the appropriate component to match.

Preferably the physical projection is in the form of a cantilevered arm that projects from one side of an excavated pit formed from cutting out below said arm. Preferably said arm is biased to an outwards position such that it places pressure on an adjacent ratcheting mechanism.

Alternatively said physical projection is in the form of a ball bearing 12 or the like.

In one embodiment said ball bearing 12 is projected from a cavity so as to interact with said ratcheting mechanism 11 (refer FIGS. 9 and 10).

In one embodiment said ball bearing 12 is connected to a spring mechanism 13 which causes said ball bearing 12 to exert pressure on said ratcheting mechanism 11.

Figure 11:
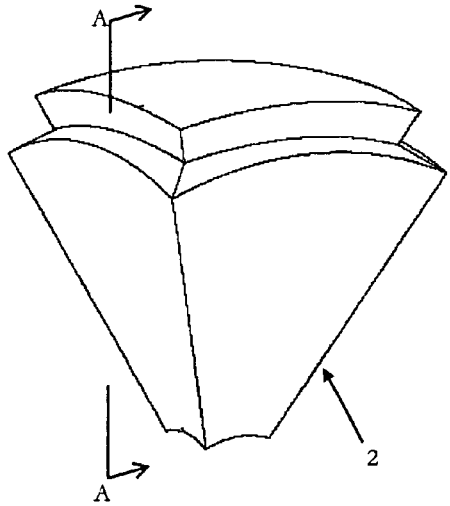
FIG. 11 is a perspective view of a piece.

In one embodiment the feedback allows a user to sense when the pieces are correctly indexed owing to the provision of an indentation 14 in the side of the playing piece which interacts with a piece 2 containing the ball bearing 12 (refer FIG. 11). In this embodiment the interaction of the ball bearing 12 with the ratcheting mechanism 11 and indentation 14 allow the user to determine when a piece 2 is rotated, and when they are in correct alignment respectively.

In one embodiment said feedback may be provided for by an interaction between the support 5 and a piece 2. Said feedback mechanism may be as described above or any other mechanism that allows a user to determine when a piece is moved, and when in a correct alignment.

The apparatus 1 may comprise an indicator that allows a user of said apparatus 1 to determine when a correct combination of said indicia 3 is aligned. Preferably the indicator is electronic and comprises such thing as a visual indication (e.g. flashing light), auditory indication (e.g. siren, music etc) etc.

In a further embodiment said apparatus includes a timing device, said timing device allowing a user to time a task (i.e. the time to align a predetermined number of indicia). Preferably said timing device is electronic.

In a further embodiment said apparatus comprises a device that gives instructions to a user. For example, the device may sound out the equation or question.

Assembly

As described the apparatus may be provided assembled or unassembled. As the apparatus comprises a support 5, a plurality of pieces 2, and optionally end caps 4, the actual apparatus can be assembled in a variety of ways. It may be that a plurality of pieces 2 are provided allowing a different combination of pieces 2 to be assembled into bands thus forming the apparatus.

The correct assembly of the apparatus 1 may enhance the educational potential of the invention requiring a user to assemble the apparatus correctly. Alternatively, the apparatus may be assembled by a teacher who then requires the user to rotate the various bands of the apparatus 1 to correctly line up the indicia 3 found on at least one piece 2 of each band. Furthermore, the apparatus 1 may be assembled to provide varying levels of difficulty for a user. For example, should the apparatus (as shown in FIG. 11) be provided to teach mathematics, the pieces 2 could be assembled into bands such that they are sequential in their numbering. This allows a user to more easily determine the correct answer as the numbers are sequentially arranged in bands. Thus the user can determine the correct answer not only based on the correct answer but also being based on the pattern of numbers. Thus, a further degree of difficulty can be provided by placing the pieces 2 into the bands in a random order. For example, when teaching mathematics the numerals of the equation may be placed in bands such that they are not sequential. Therefore, this means that a user cannot determine a correct answer merely by following a pattern.

It is envisaged that the apparatus could be supplied in a kit form whereby a number of sets of pieces 2 are supplied and thus the user can form the apparatus 1 with a variety of different combinations thus extending the use and the potential of the apparatus.

The apparatus of the present invention can be used to facilitate the teaching subtraction, multiplication, division or addition. A device of this method comprises at least three bands, at least one piece of each band having indicia such that the apparatus comprises:

1. a first band marked with a first numeral or numerals,
2. a second band marked with an operator (i.e. subtraction sign, multiplication sign, division sign, or addition sign) and a second numeral or numerals and
3. a third band marked at least with a numeral or numerals corresponding to the correct answer from the association of a first numeral or numerals with the number of the second band, subject to the operator.

In one embodiment said subtraction operator and said second number are on separate bands, such that a device of this embodiment would have at least four bands of pieces in assembly.

EXAMPLE 1

Figure 2:
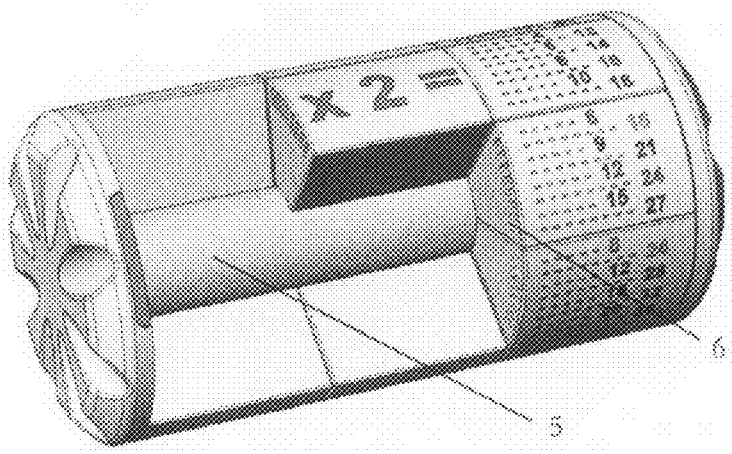
FIG. 2 is a perspective view of an apparatus of FIG. 1.
Figure 3:
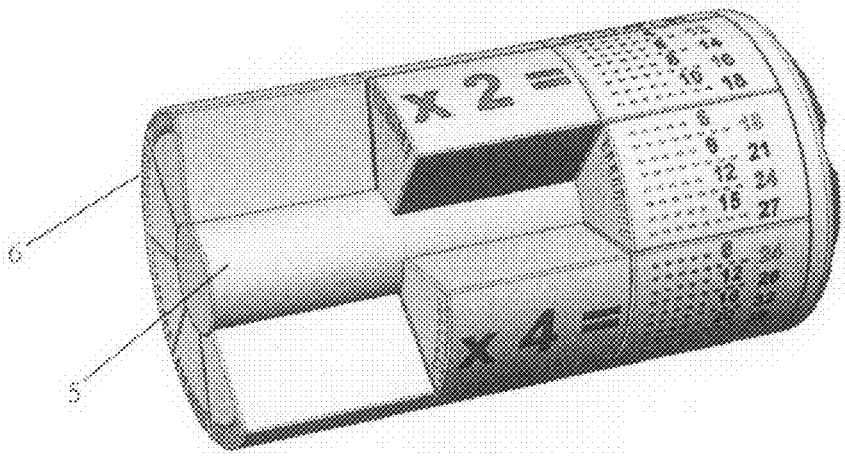
FIG. 3 is a perspective view of an apparatus of FIG. 1.
Figure 4:
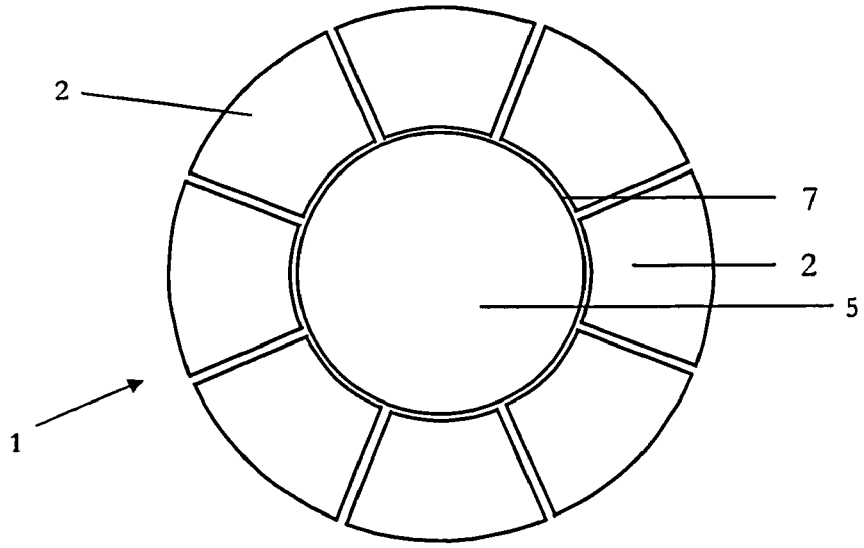
FIG. 4 is a cross-sectional view of an apparatus of FIG. 1.

With reference to FIGS. 1 to 3, in this example the apparatus 1 comprises at least three bands, at least one piece 2 of each band being marked with indicia 3 such that the apparatus comprises:

1. a first band marked with a first number,
2. a second band marked with an operator (i.e. subtraction sign, multiplication sign, division sign, or addition sign) and a second number and
3. a third band marked at least with a number corresponding to the correct answer from the association of a first number with the number of the second band, subject to the operator.

As seen in FIGS. 1 to 3, the operator, second number, and "=" sign are on the same band. However, it should be appreciated that they could be placed on separate bands such that the apparatus 1 has an additional one or two bands. The band having the operator could be held statically in place relative to the support 5. Furthermore, the band having the operator could be formed as a ring or in two halves to allow easy assembly. This also applies for the "=" sign.

Preferably the third band (i.e. with the answers on it) is marked (e.g. by colour) to indicate a correct answer by the marking matching to an indicia 3 of at least one other band. More preferably the third band is marked by colour such that it corresponds a similar colour on another band. Preferably said colour on said third band matches to the colour of the correct number and/or operator of a second band. As seen in FIGS. 1 to 3, the numbers of the second (middle band) match to the correct colour of the answer band. Therefore, in FIG. 1, the correct answer to "2×2=" is the green 4 of the answer band (third band).

As further seen in FIG. 1, the third band comprises several answers, each marked such that only one answer will correspond to the association of said first and second bands (i.e. the green 4). Thus the third row is able to be indexed to each position that corresponds to an answer.

The table below (subtraction table) shows the range of indicia that could be marked on each piece forming the three bands.

As seen in the example below (Table 1A-C) this shows the various combinations of indicia that can be used to help teach subtraction. Such indicia can be applied to an apparatus as shown in FIGS. 1 to 3. In this particular example, each band is divided up into 8 pieces with three bands in total.

With reference to Table 1A, this shows a method of teaching subtraction at a basic level. The columns are lined up such the numerals of the indicia in the pieces are arranged sequentially. This allows a user to determine a correct answer using their knowledge, colour patterning, as well as the general sequential patterning of the device owing to the sequential numbering. Thus to begin, if the apparatus is in the unassembled form, the teacher or the user can assemble the apparatus by placing the pieces 2 onto the support in the order as shown in Table 1A. The subtraction number of Column B is chosen as is the number in Column C. The user then rotates Column A (answer column) to find the right answer. The tight answer is achieved by the user aligning the correct answer to the equation is respect of all three columns. For example, in the first row there is given column "B" being "−2=" and column "C" being "2". Thus the correct answer is "4". To facilitate the correct answer the numeral 4 is coloured green to be the same colour as the indicia of column "B".

TABLE 1A-1C

Indicia for teaching subtraction - at least three different levels of difficulty.

| Table 1A | | | Table 1B | | | Table 1C | | |
|---|---|---|---|---|---|---|---|---|
| Column A | Column B | Column C | Column A | Column B | Column C | Column A | Column B | Column C |
| 4 | − 2 = | 2 | 4 | − 2 = | 4 | 6 | − 2 = | 4 |
| 8 | | | 8 | | | 10 | | |
| 5 | | | 5 | | | 7 | | |
| 9 | | | 9 | | | 11 | | |
| 6 | | | 6 | | | 8 | | |
| 10 | | | 10 | | | 12 | | |
| 7 | | | 7 | | | 9 | | |
| 11 | | | 11 | | | 13 | | |
| 5 | − 3 = | 3 | 5 | − 3 = | 9 | 10 | − 3 = | 9 |
| 9 | | | 9 | | | 14 | | |
| 6 | | | 6 | | | 11 | | |
| 10 | | | 10 | | | 15 | | |
| 7 | | | 7 | | | 12 | | |
| 11 | | | 11 | | | 16 | | |
| 8 | | | 8 | | | 13 | | |
| 12 | | | 12 | | | 17 | | |
| 6 | − 4 = | 4 | 6 | − 4 = | 7 | 4 | − 4 = | 7 |
| 10 | | | 10 | | | 8 | | |
| 7 | | | 7 | | | 5 | | |
| 11 | | | 11 | | | 9 | | |
| 8 | | | 8 | | | 6 | | |
| 12 | | | 12 | | | 10 | | |
| 9 | | | 9 | | | 7 | | |
| 13 | | | 13 | | | 11 | | |
| 7 | − 5 = | 5 | 7 | − 5 = | 3 | 11 | − 5 = | 3 |
| 11 | | | 11 | | | 15 | | |
| 8 | | | 8 | | | 12 | | |
| 12 | | | 12 | | | 16 | | |
| 9 | | | 9 | | | 13 | | |
| 13 | | | 13 | | | 17 | | |
| 10 | | | 10 | | | 14 | | |
| 14 | | | 14 | | | 18 | | |
| 8 | − 6 = | 6 | 8 | − 6 = | 8 | 9 | − 6 = | 8 |
| 12 | | | 12 | | | 13 | | |
| 9 | | | 9 | | | 10 | | |
| 13 | | | 13 | | | 14 | | |
| 10 | | | 10 | | | 11 | | |
| 14 | | | 14 | | | 15 | | |
| 11 | | | 11 | | | 12 | | |
| 15 | | | 15 | | | 16 | | |
| 9 | − 7 = | 7 | 9 | − 7 = | 2 | 7 | − 7 = | 2 |
| 13 | | | 13 | | | 11 | | |
| 10 | | | 10 | | | 8 | | |
| 14 | | | 14 | | | 12 | | |
| 11 | | | 11 | | | 9 | | |
| 15 | | | 15 | | | 13 | | |
| 12 | | | 12 | | | 10 | | |
| 16 | | | 16 | | | 14 | | |
| 10 | − 8 = | 8 | 10 | − 8 = | 6 | 8 | − 8 = | 6 |
| 14 | | | 14 | | | 12 | | |
| 11 | | | 11 | | | 9 | | |
| 15 | | | 15 | | | 13 | | |
| 12 | | | 12 | | | 10 | | |
| 16 | | | 16 | | | 14 | | |
| 13 | | | 13 | | | 11 | | |
| 17 | | | 17 | | | 15 | | |
| 11 | − 9 = | 9 | 11 | − 9 = | 5 | 5 | − 9 = | 5 |
| 15 | | | 15 | | | 9 | | |
| 12 | | | 12 | | | 6 | | |
| 16 | | | 16 | | | 10 | | |
| 13 | | | 13 | | | 7 | | |

TABLE 1A-1C-continued

| Indicia for teaching subtraction - at least three different levels of difficulty. | | | | | | | | |
|---|---|---|---|---|---|---|---|---|
| Table 1A | | | Table 1B | | | Table 1C | | |
| Column A | Column B | Column C | Column A | Column B | Column C | Column A | Column B | Column C |
| 17 | | | 17 | | | 11 | | |
| 14 | | | 14 | | | 8 | | |
| 18 | | | 18 | | | 12 | | |
| Choose the subtraction number in column B. Rotate column A which is colour coded and find the answer in column C which is in sequence. | | | Choose the subtraction number in column B. Rotate column A which is colour coded and find the answer in column C which is not in sequence. | | | Choose the subtraction number in column B. Rotate column A which is now not in sequence and find the answer in column C which is not in sequence. | | |

In a further level of advancement (shown in Table 1B), the user may set columns "A" and "B" (or a questionnaire may set these) and in which the user must rotate band "C" (column "C") such that the correct answer is given. In this instance is answer is not in sequence to make is harder for the user.

In the next step of difficulty (shown in Table 1C) both columns "A" and column "C" may not be in sequence therefore the user must determine the correct answer without receiving any help through the lining up of patterns of numbers.

As seen in the example below (Table 2A-C) this shows the various combinations of indicia that can be used to help teach addition. Such indicia can be applied to an apparatus as shown in FIGS. 1 to 3. In this particular example, each band is divided up into 8 pieces with three bands in total.

With reference to Table 2A, this shows a method of teaching addition at a basic level. The columns are lined up such the numerals of the indicia in the pieces are arranged sequentially. This allows a user to determine a correct answer using their knowledge, colour patterning, as well as the general sequential patterning of the device owing to the sequential numbering.

Thus to begin, if the apparatus is in the unassembled form, the teacher or the user can assemble the apparatus by placing the pieces 2 onto the support in the order as shown in Table 2A. The addition number of column B is chosen and the numbers of column A rotated for each given addition number (of column B). The user, for each number, must determine the correct answer in column C by rotating column C such that the correct answer is given. To help the user in determining the correct answer, the number of column B is colour matched with the correct answer in column C. Owing to the sequential placement of the pieces, a user is helped in determining subsequent answers by using the patterns of the numbers as well as the colour matching.

A further modification of teaching addition at the basic level, the user (or teacher) chooses the number in column A. Column B is rotated and the user must find the answer in column C. In this example, the column C is not colour coded, but the answer is in sequence.

In a further level of advancement (shown in Table 2B), the user may set columns "A" and "B" (or a questionnaire may set these) and in which the user must rotate band "C" (column "C") such that the correct answer is given. In this instance column C is not in sequence therefore preventing the user from replying on the pattern of numbers to identify the correct answer.

TABLE 2A-2C

| Indicia for teaching addition - at least three different levels of difficulty. | | | | | | | | |
|---|---|---|---|---|---|---|---|---|
| Table 2A | | | Table 2B | | | Table 2C | | |
| Column A | Column B | Column C | Column A | Column B | Column C | Column A | Column B | Column C |
| 2 | + 2 = | 4 | 2 | + 2 = | 6 | 4 | + 2 = | 6 |
| | | 8 | | | 10 | | | 10 |
| | | 5 | | | 7 | | | 7 |
| | | 9 | | | 11 | | | 11 |
| | | 6 | | | 8 | | | 8 |
| | | 10 | | | 12 | | | 12 |
| | | 7 | | | 9 | | | 9 |
| | | 11 | | | 13 | | | 13 |
| 3 | + 3 = | 5 | 3 | + 3 = | 8 | 9 | + 3 = | 10 |
| | | 9 | | | 12 | | | 14 |
| | | 6 | | | 9 | | | 11 |
| | | 10 | | | 13 | | | 15 |
| | | 7 | | | 10 | | | 12 |
| | | 11 | | | 14 | | | 16 |
| | | 8 | | | 11 | | | 13 |
| | | 12 | | | 15 | | | 17 |
| 4 | + 4 = | 6 | 4 | + 4 = | 4 | 7 | + 4 = | 4 |
| | | 10 | | | 8 | | | 8 |
| | | 7 | | | 5 | | | 5 |
| | | 11 | | | 9 | | | 9 |
| | | 8 | | | 6 | | | 6 |
| | | 12 | | | 10 | | | 10 |

TABLE 2A-2C-continued

Indicia for teaching addition - at least three different levels of difficulty.

| Table 2A | | | Table 2B | | | Table 2C | | |
|---|---|---|---|---|---|---|---|---|
| Column A | Column B | Column C | Column A | Column B | Column C | Column A | Column B | Column C |
| | | 9 | | | 7 | | | 7 |
| | | 13 | | | 11 | | | 11 |
| 5 | + 5 = | 7 | 5 | + 5 = | 11 | 3 | + 5 = | 11 |
| | | 11 | | | 15 | | | 15 |
| | | 8 | | | 12 | | | 12 |
| | | 12 | | | 16 | | | 16 |
| | | 9 | | | 13 | | | 13 |
| | | 13 | | | 17 | | | 17 |
| | | 10 | | | 14 | | | 14 |
| | | 14 | | | 18 | | | 18 |
| 6 | + 6 = | 8 | 6 | + 6 = | 10 | 8 | + 6 = | 9 |
| | | 12 | | | 14 | | | 13 |
| | | 9 | | | 11 | | | 10 |
| | | 13 | | | 15 | | | 14 |
| | | 10 | | | 12 | | | 11 |
| | | 14 | | | 16 | | | 15 |
| | | 11 | | | 13 | | | 12 |
| | | 15 | | | 17 | | | 16 |
| 7 | + 7 = | 9 | 7 | + 7 = | 5 | 2 | + 7 = | 7 |
| | | 13 | | | 9 | | | 11 |
| | | 10 | | | 6 | | | 8 |
| | | 14 | | | 10 | | | 12 |
| | | 11 | | | 7 | | | 9 |
| | | 16 | | | 11 | | | 13 |
| | | 12 | | | 8 | | | 10 |
| | | 16 | | | 12 | | | 14 |
| 8 | + 8 = | 10 | 8 | + 8 = | 7 | 6 | + 8 = | 8 |
| | | 14 | | | 11 | | | 12 |
| | | 11 | | | 8 | | | 9 |
| | | 15 | | | 12 | | | 13 |
| | | 12 | | | 9 | | | 10 |
| | | 16 | | | 13 | | | 14 |
| | | 13 | | | 10 | | | 11 |
| | | 17 | | | 14 | | | 15 |
| 9 | + 9 = | 11 | 9 | + 9 = | 9 | 5 | + 9 = | 5 |
| | | 15 | | | 13 | | | 9 |
| | | 12 | | | 10 | | | 6 |
| | | 16 | | | 14 | | | 10 |
| | | 13 | | | 11 | | | 7 |
| | | 17 | | | 15 | | | 11 |
| | | 14 | | | 12 | | | 8 |
| | | 18 | | | 16 | | | 12 |
| Choose the addition number in column B. Rotate column A and find the answer in column C which is colour coded in sequence. | | | Choose the addition number in column B. Rotate column A and find the answer in column C which is colour coded and not in sequence. | | | Choose the addition number in column B. Rotate column A which is now not in sequence and find the answer in column C which is colour coded but not in sequence. | | |

A further modification of teaching addition at a more advance level, the user (or teacher) chooses the number in column A. Column B is rotated and the user must find the answer in column C. In this example, the column C is not colour coded and is not in sequence.

In the next step of difficulty (shown in Table 2C) both columns "A" and column "C" are not be in sequence therefore the user must determine the correct answer without receiving any help through the lining up of patterns of number.

A further modification of teaching addition at a more advance level, the user (or teacher) chooses the number in column A. Column B is rotated (which is now not in sequence) and the user must find the answer in column C. In this example, the column C is not colour coded and is not in sequence.

As seen in the example below (Table 3A-C) this shows the various combinations of indicia that can be used to help teach multiplication. Such indicia can be applied to an apparatus as shown in FIGS. 1 to 3. In this particular example, each band is divided up into 8 pieces with three bands in total.

With reference to Table 3A, this shows a method of teaching multiplication at a basic level. The columns are lined up such the numerals of the indicia in the pieces are arranged sequentially. This allows a user to determine a correct answer using their knowledge, colour patterning, as well as the general sequential patterning of the device owing to the sequential numbering.

Thus to begin, if the apparatus is in the unassembled form, the teacher or the user can assemble the apparatus by placing the pieces 2 onto the support in the order as shown in Table 3A. The multiplication number of column B is chosen and the numbers of column A rotated for each given addition number (of column B). The user, for each number, must determine the correct answer in column C by rotating column C such that the correct answer is given. To help the user in determining the correct answer, the number of column B is colour matched with the correct answer in column C. Owing to the sequential placement of the pieces, a user is helped in determining subsequent answers by using the patterns of the numbers as well as the colour matching.

A further modification of teaching multiplication at the basic level, the user (or teacher) chooses the number in column A. Column B is rotated and the user must find the answer in column C. In this example, the column C is not colour coded, but the answer is in sequence.

TABLE 3A-3C

Indicia for teaching multiplication - at least three different levels of difficulty.

| Table 3A | | | Table 3B | | | Table 3C | | |
|---|---|---|---|---|---|---|---|---|
| Column A | Column B | Column C | Column A | Column B | Column C | Column A | Column B | Column C |
| 2 | × 2 = | 4 | 2 | × 2 = | 8 | 4 | × 2 = | 8 |
| | | 12 | | | 24 | | | 24 |
| | | 6 | | | 12 | | | 12 |
| | | 14 | | | 28 | | | 28 |
| | | 8 | | | 14 | | | 14 |
| | | 16 | | | 32 | | | 32 |
| | | 10 | | | 20 | | | 20 |
| | | 18 | | | 36 | | | 36 |
| 3 | × 3 = | 6 | 3 | × 3 = | 12 | 9 | × 3 = | 12 |
| | | 18 | | | 36 | | | 36 |
| | | 9 | | | 18 | | | 18 |
| | | 21 | | | 42 | | | 42 |
| | | 12 | | | 24 | | | 24 |
| | | 24 | | | 48 | | | 48 |
| | | 15 | | | 30 | | | 30 |
| | | 27 | | | 54 | | | 54 |
| 4 | × 4 = | 8 | 4 | × 4 = | 4 | 7 | × 4 = | 4 |
| | | 24 | | | 12 | | | 12 |
| | | 12 | | | 6 | | | 6 |
| | | 28 | | | 14 | | | 14 |
| | | 14 | | | 8 | | | 8 |
| | | 32 | | | 16 | | | 16 |
| | | 20 | | | 10 | | | 10 |
| | | 36 | | | 18 | | | 18 |
| 5 | × 5 = | 10 | 5 | × 5 = | 14 | 3 | × 5 = | 14 |
| | | 30 | | | 42 | | | 42 |
| | | 15 | | | 21 | | | 21 |
| | | 35 | | | 49 | | | 49 |
| | | 20 | | | 28 | | | 28 |
| | | 40 | | | 56 | | | 56 |
| | | 25 | | | 35 | | | 35 |
| | | 45 | | | 63 | | | 63 |
| 6 | × 6 = | 12 | 6 | × 6 = | 10 | 8 | × 6 = | 10 |
| | | 36 | | | 30 | | | 30 |
| | | 18 | | | 15 | | | 15 |
| | | 42 | | | 35 | | | 35 |
| | | 24 | | | 20 | | | 20 |
| | | 48 | | | 40 | | | 40 |
| | | 30 | | | 25 | | | 25 |
| | | 54 | | | 45 | | | 45 |
| 7 | × 7 = | 14 | 7 | × 7 = | 16 | 2 | × 7 = | 16 |
| | | 42 | | | 48 | | | 48 |
| | | 21 | | | 24 | | | 24 |
| | | 49 | | | 56 | | | 56 |
| | | 28 | | | 32 | | | 32 |
| | | 56 | | | 64 | | | 64 |
| | | 35 | | | 40 | | | 40 |
| | | 63 | | | 72 | | | 72 |
| 8 | × 8 = | 16 | 8 | × 8 = | 18 | 6 | × 8 = | 18 |
| | | 48 | | | 54 | | | 54 |
| | | 24 | | | 27 | | | 27 |
| | | 56 | | | 63 | | | 63 |
| | | 32 | | | 36 | | | 36 |
| | | 64 | | | 72 | | | 72 |
| | | 40 | | | 45 | | | 45 |
| | | 72 | | | 81 | | | 81 |
| 9 | × 9 = | 18 | 9 | × 9 = | 6 | 5 | × 9 = | 6 |
| | | 54 | | | 18 | | | 18 |
| | | 27 | | | 9 | | | 9 |
| | | 63 | | | 21 | | | 21 |
| | | 36 | | | 12 | | | 12 |
| | | 72 | | | 24 | | | 24 |
| | | 45 | | | 15 | | | 15 |
| | | 81 | | | 27 | | | 27 |
| Choose times table in column B. Rotate column A and find the answer | | | Choose times table in column B. Rotate column A and find the answer in | | | Choose times table in column B. Rotate column A which is now not in | | |

TABLE 3A-3C-continued

| Indicia for teaching multiplication - at least three different levels of difficulty. | | | | | | | | |
|---|---|---|---|---|---|---|---|---|
| Table 3A | | | Table 3B | | | Table 3C | | |
| Column A | Column B | Column C | Column A | Column B | Column C | Column A | Column B | Column C |
| in column C which is colour coded in sequence. | | | column C which is colour coded and not in sequence. | | | sequence and find the answer in column C which is colour coded but not in sequence. | | |

In a further level of advancement (shown in Table 3B), the user may set columns "A" and "B" (or a questionnaire may set these) and in which the user must rotate band "C" (column "C") such that the correct answer is given. In this instance column C is not in sequence therefore preventing the user from replying on the pattern of numbers to identify the correct answer.

A further modification of teaching multiplication at a more advance level, the user (or teacher) chooses the number in column A. Column B is rotated and the user must find the answer in column C. In this example, the column C is not colour coded and is not in sequence.

In the next step of difficulty (shown in Table 3C) both columns "A" and column "C" are not be in sequence therefore the user must determine the correct answer without receiving any help through the lining up of patterns of number.

A further modification of teaching multiplication at a more advance level, the user (or teacher) chooses the number in column A. Column B is rotated (which is now not in sequence) and the user must find the answer in column C. In this example, the column C is not colour coded and is not in sequence.

As seen in the example below (Table 4A-C) this shows the various combinations of indicia that can be used to help teach division. Such indicia can be applied to an apparatus as shown in FIGS. 1 to 3. In this particular example, each band is divided up into 8 pieces with three bands in total.

With reference to Table 3A, this shows a method of teaching division at a basic level. The columns are lined up such the numerals of the indicia in the pieces are arranged sequentially. This allows a user to determine a correct answer using their knowledge, colour patterning, as well as the general sequential patterning of the device awing to the sequential numbering.

Thus to begin, if the apparatus is in the unassembled form, the teacher or the user can assemble the apparatus by placing the pieces 2 onto the support in the order as shown in Table 4A. The division number of column B is chosen and the numbers of column A rotated for each given addition number (of column B). The user, for each number, must determine the correct answer in column C by rotating column C such that the correct answer is given. To help the user in determining the correct answer, the number of column B is colour matched with the correct answer in column C. Owing to the sequential placement of the pieces, a user is helped in determining subsequent answers by using the patterns of the numbers as well as the colour matching.

TABLE 4A-4C

| Indicia for teaching division - at least three different levels of difficulty. | | | | | | | | |
|---|---|---|---|---|---|---|---|---|
| Table 4A | | | Table 4B | | | Table 4C | | |
| Column A | Column B | Column C | Column A | Column B | Column C | Column A | Column B | Column C |
| 4 | /2 = | 2 | 4 | /2 = | 8 | 8 | /2 = | 8 |
| 6 | | | 6 | | | 12 | | |
| 8 | | | 8 | | | 16 | | |
| 10 | | | 10 | | | 20 | | |
| 12 | | | 12 | | | 24 | | |
| 14 | | | 14 | | | 28 | | |
| 16 | | | 16 | | | 32 | | |
| 18 | | | 18 | | | 36 | | |
| 6 | /3 = | 3 | 6 | /3 = | 5 | 14 | /3 = | 5 |
| 18 | | | 18 | | | 21 | | |
| 9 | | | 9 | | | 28 | | |
| 21 | | | 21 | | | 35 | | |
| 12 | | | 12 | | | 42 | | |
| 24 | | | 24 | | | 49 | | |
| 15 | | | 15 | | | 56 | | |
| 27 | | | 27 | | | 63 | | |
| 8 | /4 = | 4 | 8 | /4 = | 2 | 4 | /4 = | 2 |
| 12 | | | 12 | | | 6 | | |
| 16 | | | 16 | | | 8 | | |
| 20 | | | 20 | | | 10 | | |
| 24 | | | 24 | | | 12 | | |
| 28 | | | 28 | | | 14 | | |
| 32 | | | 32 | | | 16 | | |
| 36 | | | 36 | | | 18 | | |
| 10 | /5 = | 5 | 10 | /5 = | 9 | 12 | /5 = | 9 |
| 15 | | | 15 | | | 18 | | |
| 20 | | | 20 | | | 24 | | |

TABLE 4A-4C-continued

Indicia for teaching division - at least three different levels of difficulty.

| Table 4A | | | Table 4B | | | Table 4C | | |
|---|---|---|---|---|---|---|---|---|
| Column A | Column B | Column C | Column A | Column B | Column C | Column A | Column B | Column C |
| 25 | | | 25 | | | 30 | | |
| 30 | | | 30 | | | 36 | | |
| 35 | | | 35 | | | 42 | | |
| 40 | | | 40 | | | 48 | | |
| 45 | | | 45 | | | 54 | | |
| 12 | /6 = | 6 | 12 | /6 = | 3 | 18 | /6 = | 3 |
| 18 | | | 18 | | | 27 | | |
| 24 | | | 24 | | | 36 | | |
| 30 | | | 30 | | | 45 | | |
| 36 | | | 36 | | | 54 | | |
| 42 | | | 42 | | | 63 | | |
| 48 | | | 48 | | | 72 | | |
| 54 | | | 54 | | | 81 | | |
| 14 | /7 = | 7 | 14 | /7 = | 6 | 16 | /7 = | 6 |
| 21 | | | 21 | | | 24 | | |
| 28 | | | 28 | | | 32 | | |
| 35 | | | 35 | | | 40 | | |
| 42 | | | 42 | | | 48 | | |
| 49 | | | 49 | | | 56 | | |
| 56 | | | 56 | | | 64 | | |
| 63 | | | 63 | | | 72 | | |
| 16 | /8 = | 8 | 16 | /8 = | 4 | 10 | /8 = | 4 |
| 24 | | | 24 | | | 15 | | |
| 32 | | | 32 | | | 20 | | |
| 40 | | | 40 | | | 25 | | |
| 48 | | | 48 | | | 30 | | |
| 56 | | | 56 | | | 35 | | |
| 64 | | | 64 | | | 40 | | |
| 72 | | | 72 | | | 45 | | |
| 18 | /9 = | 9 | 18 | /9 = | 7 | 6 | /9 = | 7 |
| 27 | | | 27 | | | 18 | | |
| 36 | | | 36 | | | 9 | | |
| 45 | | | 45 | | | 21 | | |
| 54 | | | 54 | | | 12 | | |
| 63 | | | 63 | | | 24 | | |
| 72 | | | 72 | | | 15 | | |
| 81 | | | 81 | | | 27 | | |
| Choose divider in column B. Rotate column A which is colour coded and find the answer in column C which is in sequence. | | | Choose divider in column B. Rotate column A which is colour coded and find the answer in column C which is not in sequence. | | | Choose divider in column B. Rotate column A which is now not in sequence and find the answer in column C which is not in sequence. | | |

In a further level of advancement (shown in Table 3B), the user may set columns "A" and "B" (or a questionnaire may set these) and in which the user must rotate band "C" (column "C") such that the correct answer is given. In this instance column C is not in sequence therefore preventing the user from replying on the pattern of numbers to identify the correct answer.

In the next step of difficulty (shown in Table 4C) both columns "A" and column "C" are not be in sequence therefore the user must determine the correct answer without receiving any help through the lining up of patterns of number.

It should be appreciated that in all of the above examples, the ordering of the answer column can be varied, yet still retain the same effects as described above. Other permutations of number ordering can be used. For example, the answer column may be set out so that, whilst each pieces of a band comprises multiple answers, the effect of arranging a single piece in the right alignment gives the correct answer for the subsequent equations of the subsequent pieces in that band.

EXAMPLE 2

In a further embodiment of the present invention, said apparatus may comprise indicia to facilitate the teaching of a subject matter such as geography, grammar, spelling etc. For example, to teach geography, a first band may have pieces inscribed with pictures of a country, a subsequent band having pieces inscribed with various capital city names, and a further band having pieces inscribed with country names.

Likewise to teach spelling or grammar. A number of bands can be assembled, each band having pieces inscribed with phonemes, letters etc that need to be aligned correctly to spell words etc.

Although the invention has been described by way of example and with reference to particular embodiments, it is to be understood that modifications and/or improvements may be made without departing from the scope or spirit of the invention.

I claim:

1. A puzzle, toy or educational apparatus, the apparatus being in the form of an assembly of components, or an assembliable kit, to define:

(1) an elongate support, (2) a number of individual pieces collectively forming a completely circumferential band about, and adjacent, the elongate support and the circumferential band being rotatable as a whole about an axis of said elongate support, and (3) at least one other circumferential band disposed about said axis, wherein there is a magnetic interaction (A) between at least one individual piece and an adjacent individual piece of a same circumferential band, (B) between said elongate support and at least one individual piece of said circumferential band, or (C) between both (i) at least one individual piece and an adjacent individual piece of a same circumferential band, and (ii) between said elongate support and at least one individual piece of said circumferential band, and wherein rotation of said rotatable circumferential band allows alignment or disalignment at least substantially parallel to said axis, of indicia of said rotatable band with indicia of said other circumferential band;

the circumferential bands, when rotated about the elongate support, providing feedback to a user by a feedback mechanism, the feedback during movement of said at least one circumferential band provides at least one or more of the following outcomes:

a sense of moving beyond an indexed position, and a sense of indexing to a desired or correct position, the feedback mechanism being located on, (a) opposing surfaces of said circumferential bands, (b) the elongate support and the circumferential bands, or (c) both the opposing surfaces of said circumferential bands and the elongate support and the circumferential bands.

2. The apparatus of claim 1, wherein there is a magnetic interaction between the elongate support and each individual piece.

3. The apparatus of claim 1, wherein each band carries circumferentially spaced about said axis a plurality of indicia directed towards a subject matter to be taught.

4. The apparatus as claimed in claim 1, wherein, axially spaced with respect of said axis, there are at least two rotatable circumferential bands.

5. The apparatus of claim 4, wherein one band of said two rotatable circumferential bands is fixed in place, either statically in respect of said support, or by being attached to said support.

6. The apparatus of claim 1, wherein at least one piece of each band having indicia such that the apparatus further comprises:

(1) the circumferential band having at least one individual piece with an indicia in the form of a numeral, (2) the other circumferential band having at least one individual piece marked with an operator and a numeral, and (3) a third band having at least one individual piece marked with one numeral in a group of a plurality of numerals corresponding to a correct answer from association of the numeral of said circumferential band with the numeral of the other circumferential band, subject to the operator.

7. The apparatus of claim 6, wherein the third band is marked to indicate a correct answer or correct alignment of pieces.

8. The apparatus of claim 6, further comprising an indicator allowing a user to determine when a correct combination of the indicia is aligned.

9. The apparatus of claim 1, wherein each said circumferential band is divided into multiple pieces and each piece has an arc length of substantially a same size.

10. The apparatus of claim 1, wherein the feedback mechanism is provided by one or more of:

(1) ratcheting mechanisms on each of said opposed surfaces, (2) a ratcheting mechanism on one surface, and a physical projection on the opposing surface, and (3) physical projections on each of said opposing surfaces.

11. The apparatus of claim 6, wherein the apparatus includes three bands having a plurality of pieces.

12. The apparatus of claim 11, wherein the third band is rotatable relative to at least one other adjacent band.

13. The apparatus of claim 11, wherein the pieces of the three bands, each as a set, defines a meaningful equation, statement, or expression of a game or as an educational aide.

14. The apparatus of claim 6, wherein one band is fixed in place, either statically in respect of said elongate support, or by being attached to said support.

* * * * *

UNITED STATES PATENT AND TRADEMARK OFFICE

CERTIFICATE OF CORRECTION

PATENT NO. : 8,398,080 B2
APPLICATION NO. : 12/223469
DATED : March 19, 2013
INVENTOR(S) : Mark Randall Stolten It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 754 days.

Signed and Sealed this
First Day of September, 2015

Michelle K. Lee

Michelle K. Lee
*Director of the United States Patent and Trademark Office*